US011178924B2

(12) United States Patent
Schlatterer

(10) Patent No.: US 11,178,924 B2
(45) Date of Patent: Nov. 23, 2021

(54) TWO TONED GOWNS FOR OPERATING ROOM PERSONNEL

(71) Applicant: Daniel Robert Schlatterer, Dunwoody, GA (US)

(72) Inventor: Daniel Robert Schlatterer, Dunwoody, GA (US)

( * ) Notice: Subject to any disclaimer, the term of this patent is extended or adjusted under 35 U.S.C. 154(b) by 488 days.

(21) Appl. No.: 15/245,991

(22) Filed: Aug. 24, 2016

(65) Prior Publication Data

US 2018/0055109 A1 Mar. 1, 2018

(51) Int. Cl.
*A41D 13/12* (2006.01)
*A41D 27/08* (2006.01)

(52) U.S. Cl.
CPC ..... *A41D 13/1209* (2013.01); *A41D 27/08* (2013.01); *A41D 2500/54* (2013.01)

(58) Field of Classification Search
CPC ..... A41D 13/1209; A41D 2500/54; A41D 13/0012; A41D 27/20; A41D 13/01; A41D 13/02; A41D 13/04; A41D 1/04; A41D 1/02; A41D 3/005; A41D 3/02; A41D 3/04; A41D 3/06; A41D 3/08; A41D 3/00; A61L 2/18; A62B 17/00; A61Q 1/02; C09D 11/50
USPC .... 2/51, 114, 457, 456, 246, 161.7, 159, 46; 424/63
See application file for complete search history.

(56) References Cited

U.S. PATENT DOCUMENTS 2,423,565 A * 7/1947 Rodman ..... C08L 29/14 525/58
3,875,071 A * 4/1975 Grand ..... A61K 8/40 510/382
4,089,722 A * 5/1978 Holoubek ..... B44C 1/1725 156/230
5,276,075 A * 1/1994 Santini ..... B05D 5/067 524/40
5,334,436 A * 8/1994 Hobbs ..... A62B 17/00 428/195.1
5,673,433 A * 10/1997 Rothrum ..... A41D 13/1209 2/46
7,748,060 B2 * 7/2010 Plut ..... A41D 13/02 2/457
7,802,313 B2 9/2010 Czajka
(Continued)

OTHER PUBLICATIONS

Getty Images, The Tonight Show With Jay Leno—Episode 1738—Pictured: (l-r) Comedian Robin Williams and musical guest Blue Man Group perform on Dec. 13, 1999 , https://www.gettyimages.com/detail/news-photo/episode-1738-pictured-comedian-robin-williams-and-musical-news-photo/144895808?adppopup=true.*
(Continued)

*Primary Examiner* — Khoa D Huynh
*Assistant Examiner* — Abby M Spatz
(74) *Attorney, Agent, or Firm* — David L. King

(57) ABSTRACT

The present invention is an improvement to surgical gown with two distinctive features. 1) the back of the gown and the back of the gown sleeves are a contrasting or bright color and 2) these same two-toned gown areas, back of sleeves and gown back top to bottom could also have a resin painted on that would transfer to any object it comes into contact with. Resin transfer will result in a visible change in the gown, a color change and/or bare spot in the resin loss region of the gown.

6 Claims, 6 Drawing Sheets
(6 of 6 Drawing Sheet(s) Filed in Color)

(56) References Cited

U.S. PATENT DOCUMENTS

| | | | | |
|---|---|---|---|---|
| 8,646,114 | B1 * | 2/2014 | Williams | A41D 13/1236 2/114 |
| 9,179,716 | B2 * | 11/2015 | Forbes | A41D 13/1236 |
| 9,392,824 | B1 * | 7/2016 | Leschinsky | A41D 13/0012 |
| 2007/0000010 | A1 * | 1/2007 | Benini | A41D 13/0002 2/69 |
| 2010/0119755 | A1 | 5/2010 | Chung et al. | |
| 2013/0104284 | A1 * | 5/2013 | Kantrowitz | A41D 19/0031 2/161.7 |
| 2016/0081405 | A1 * | 3/2016 | Gubitosa | A41D 13/1236 2/114 |

OTHER PUBLICATIONS

BluemangroupLondon ,Robin Willians is the Human Paintbrush!, Mar. 19, 2008, https://www.youtube.com/watch?v=_Nau6B38luc.*

* cited by examiner

TWO TONED GOWNS FOR OPERATING ROOM PERSONNEL

TECHNICAL FIELD

The present invention relates to an improved method of maintaining sterility in the operating room. This invention also relates to aiding in the identification of when a non-sterile area has been touched by operating room personnel. One such application would be for all personnel involved in a sterile procedure to don these two-toned gowns.

BACKGROUND OF THE INVENTION

Prevention of an infection during surgical procedures is of utmost importance. Surgical site infections (SSIs) are currently a major burden in health care. SSIs lead to increased length of stay for a given hospital admission for a given surgical procedure, increased costs relate directly to treating the infection itself and in some cases a SSI may lead to loss of a limb and even loss of a life.

Multiple protocols have been developed over the past century to reduce SSI rates. These protocols include; administration of antibiotics before the surgery begins, cleaning and cleansing the skin where the site of the incision is to be made, another protocol is creating a sterile field for the surgical procedure.

Creating and maintaining a sterile field is a labor intensive task requiring all operating personnel to wear sterile gloves and gowns. The operating room personnel must be diligent and carefully watch what they touch and where and what other members of the surgical team touch or what they come into contact with. It is a collective effort to keep watch on each other. Surgical team members alert each other if they observe that someone on the team has touched or come into contact with something not sterile. The contact is most often the back of the gown or the backs of the gown sleeves. These areas are very hard for the gown wearer to directly observe, and avoid contacting something not sterile.

In an attempt to minimize compromising the sterile field the operating room (OR) staff wear caps on their heads and masks over their mouths. It is well established that humans shed fine particles containing bacteria and OR staff wear caps and gowns to cover their entire body to minimize shedding and surgical site contamination. Unfortunately all operating room sterile attire especially gowns lose their sterility soon after it comes out of its packaging. Usually it is the back of the gown and the backs of the sleeves of the gown that become non-sterile first. As soon as the gown is donned, the OR staff member often inadvertently brushes against someone or something in the OR that is non-sterile. Furthermore, the rest of the OR staff have no idea that a member of the surgical team is now contaminated. A cycle follows whereby this individual cross contaminates the rest of the OR team increasing exponentially the chance of a surgical site infection.

A surgical site infection follows when something laden with bacteria enters the surgical site. The sources of this bacteria are too numerous to list. Suffice it to say that at some point a break in sterility occurs, either a hole in the surgeon's glove or particles floating in the air settle into the surgical incision and an infection develops days later. It is for these reasons that maintaining sterility in and around the surgical field is imperative. The surgical team cannot get holes in their gloves, lose their caps or masks or contaminate their gowns. Contaminated gowns may contaminate the gloves of someone on the surgical team, these same gloves would then cross contaminate the sterile instruments and the sterile implants and vectors have been created carrying bacteria into the surgical site.

Prevention is the key to reducing SSIs.

SUMMARY OF THE INVENTION

The present invention is a sterility indicating operating room surgical gown with two distinctive features. 1) the outer surfaces of the back of the gown and the back of the gown sleeves are a contrasting or distinctly colored second color relative to a first color of outer surfaces of the gown and 2) these same two-toned gown areas, back of sleeves and gown back top to bottom could also have a resin painted on that would transfer to any object it comes into contact with. Resin transfer will result in a visible change in the gown a color change and/or bare spot in the resin loss region of the gown.

The problem is surgical site infections which is directly related to poor visibility of frequently contaminated areas of gowns, the solution can be twofold. The first solution to gown contamination is to improve its visibility of the gown back and the back of the sleeves to the OR staff can be twofold. The first solution is to manufacture a two-toned gown. The back of the gown and the back of the sleeves would be contrasting or brightly colored such as yellow, orange or red or pink. The color demarcation would better assist all people in the OR to identify areas of the gown that are absolutely no touch zones. The color demarcation would also make it easier for some member of the OR team to identify if this area came into contact with something not sterile. Someone in the OR could more easily say "Yes I just saw the orange part of your sleeve back touch the wall "yes you need to change into a new sterile gown".

A second solution would be to cover these same areas of the gowns with some sort of transferable resin. Whereby this resin would come off of the gown and mark whatever it comes into contact with whether it be the wall or another object or person in the Operating Room. This process would ensure identification of a break in sterility because there would be a bare spot on the gown or even a color change and help identify all persons and, or objects no longer sterile in the OR because these persons or objects would have gown residue on them signifying that someone inadvertently touched them and broke sterility.

BRIEF DESCRIPTION OF THE DRAWINGS

The patent or application file contains at least one drawing/photograph executed in color. Copies of this patent or patent application publication with color drawing(s) will be provided by the Office upon request and payment of the necessary fee. The invention will be described by way of example and with reference to the accompanying drawings in which.

DETAILED DESCRIPTION OF THE INVENTION

Figure 1A:
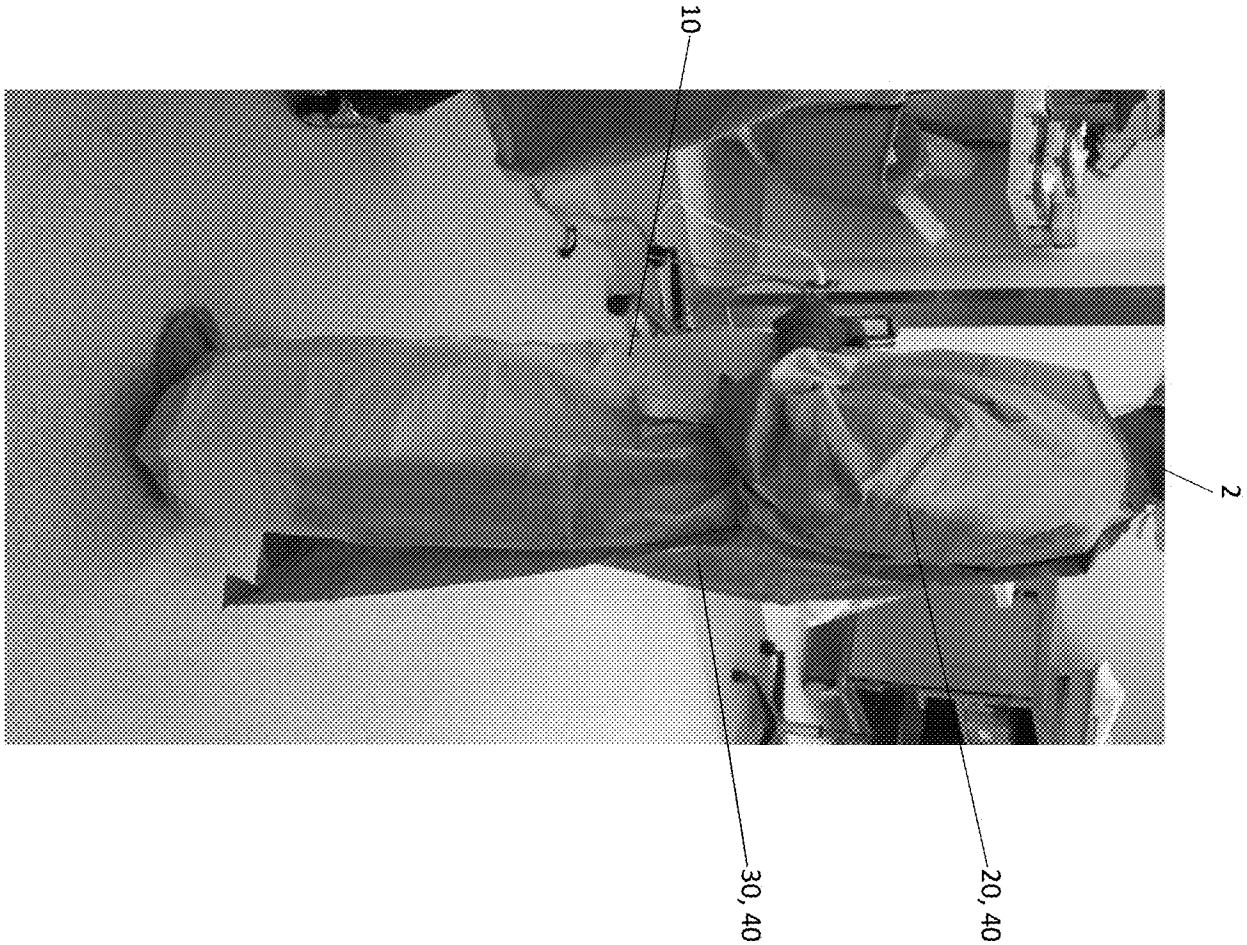
FIG. 1A is a photograph of a side view of a two-toned gown of the present invention.

With reference to FIG. 1A, a side profile is shown of a surgeon 2 in a blue or colored gown 10 in which the outer surfaces of the sleeve backs 20 and the back 30 of the gown 10 have been distinctly colored with a second color, as shown in the exemplary view, spray painted orange to denote/demark non-sterile areas of the gown to avoid coming into any contact by other members of the surgical team, especially their hands. This picture is an embodiment of the present invention.

Figure 1B:
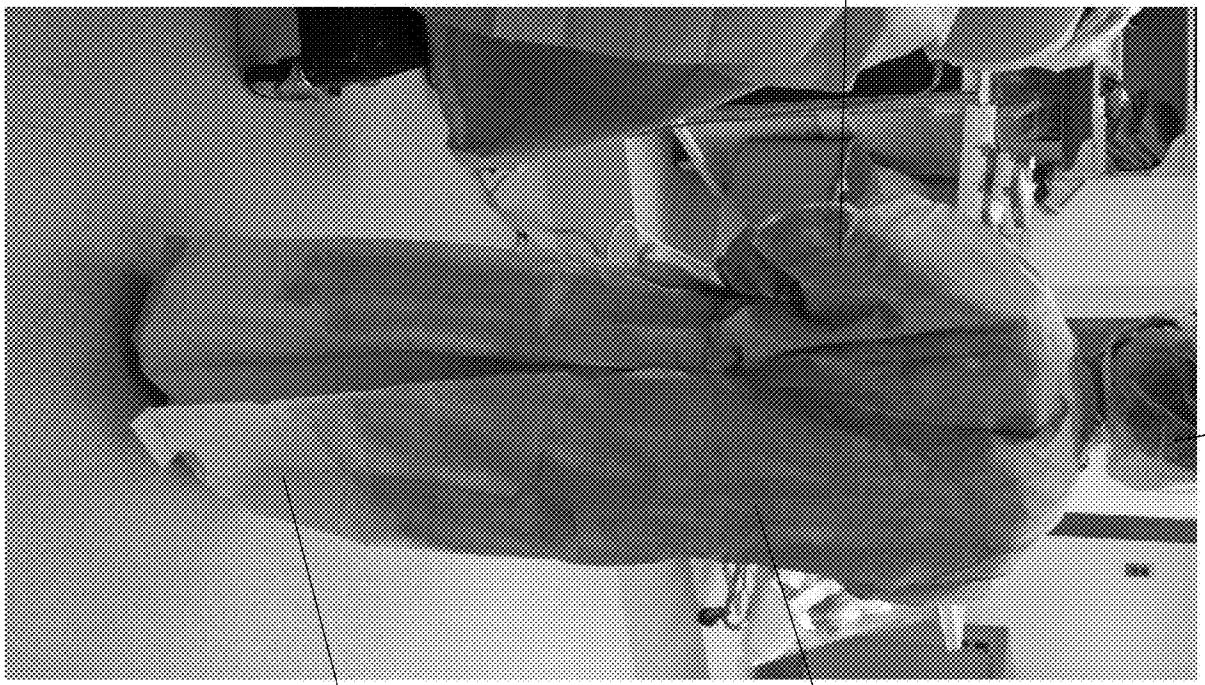
FIG. 1B is a back view of the two-toned gown of FIG. 1A.

With reference to FIG. 1B, the back profile of picture 1A is shown of the surgeon 2 in the blue gown 10 in which the sleeve backs 20 and the back 30 of the gown 10 have been colored with the second color, as shown, spray painted orange color to denote/demark non-sterile areas of the gown 10 to avoid coming into any contact by other members of the surgical team, especially their hands. This picture is a further perspective of the embodiment of the present invention. In FIGS. 1A and 1B, the areas of orange paint can be made from an easily transferable resin 40 to mark Operating Room (OR) personnel and/or objects in the OR that had inadvertently been touched by the gowned surgical team.

Figure 2A:
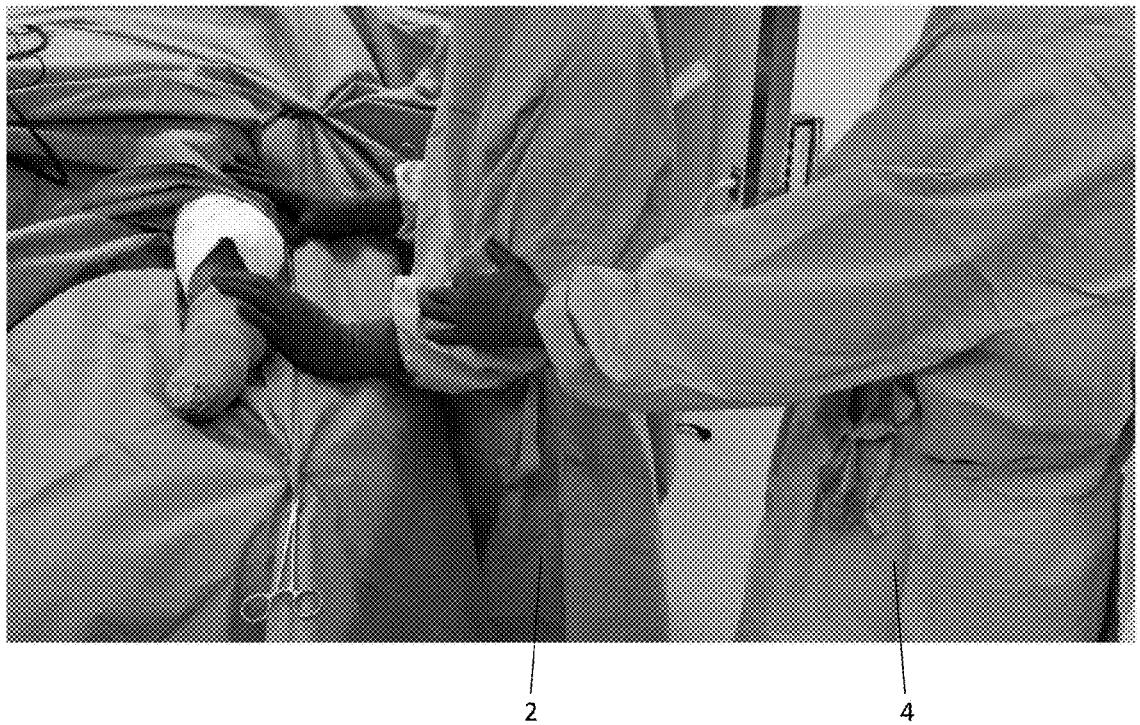
FIG. 2A illustrates how a co-surgeon or resident assistant may attempt to get the surgeon's attention. In this picture, the assistant is touching an off limit area for touching on the side and back of the surgeon's sleeve.

FIG. 2A illustrates how a co-surgeon 4 or resident assistant 4 may attempt to get the surgeon's 2 attention. In this picture, the assistant 4 is touching an off limit area for touching on the side and back 20 of the surgeon's sleeve.

Figure 2B:
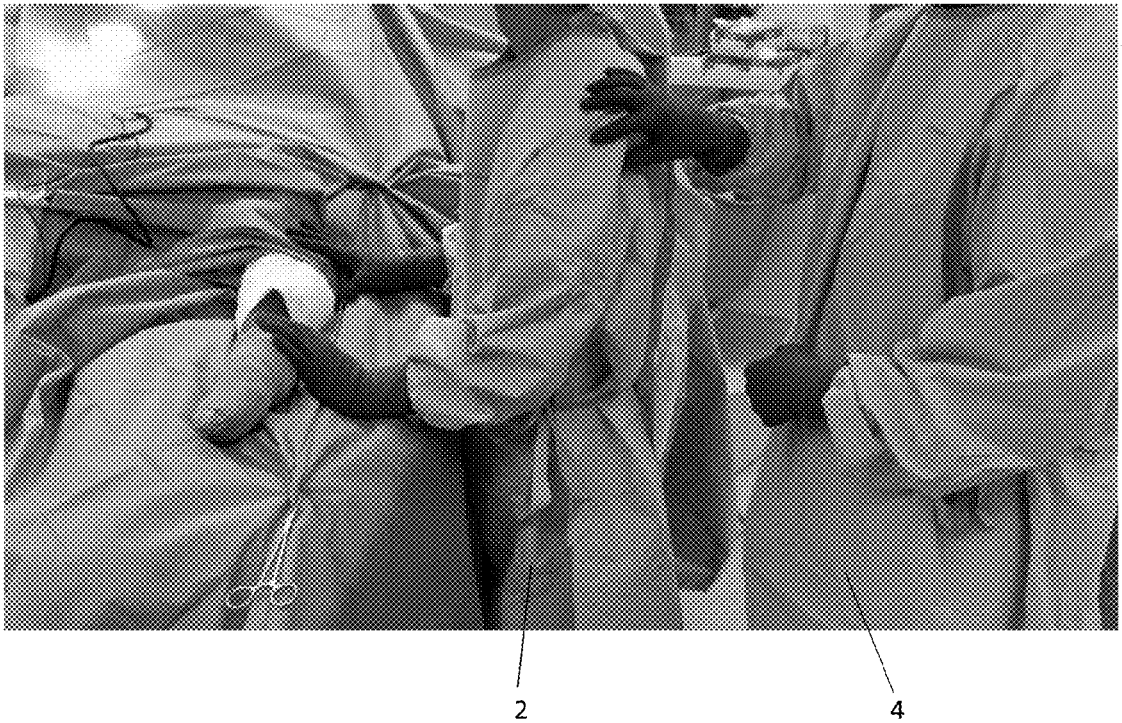
FIG. 2B is similar to picture 2A, again illustrating how a co-surgeon or resident assistant may attempt to get the surgeon's attention in this picture the assistant is touching an off limit area by touching on the upper part of the surgeon's back.

FIG. 2B similar to FIG. 2A again illustrating how a co-surgeon 4 or resident assistant 4 may attempt to get the surgeon's 2 attention in this picture the assistant 4 is touching an off limit area by touching on the upper part of the surgeon's back 30.

Figure 3:
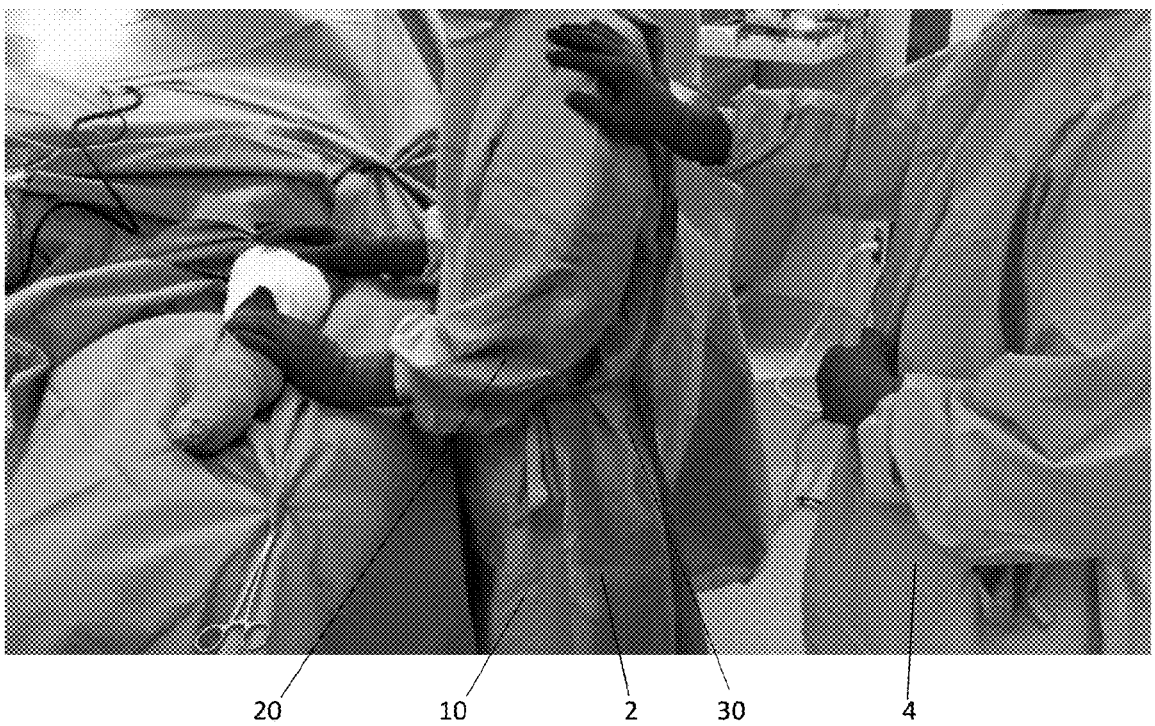
FIG. 3 illustrates again how a co-surgeon or resident assistant may attempt to get the surgeon's attention, but in this picture now it is likely more obvious to the assistant that he/she is touching an off limit area for touching on the back of the surgeon's gown and the assistant is more likely to not touch this bright orange off limit area of the surgeon's gown, and he/she is much less likely to break field sterility if the surgeon had worn this two-toned gown. The risky areas are much more visible and less likely to be touched inadvertently.

FIG. 3 again illustrates how a co-surgeon or resident assistant 4 may attempt to get the surgeon's 2 attention, but in this picture with the two-toned gown 10 of the present invention, now it is likely more obvious to the assistant 4 that he/she is touching an off limit area for touching on the back of the surgeon's gown 10 and the assistant 4 is more likely to not touch this bright orange off limit area of the surgeon's gown, and he/she is much less likely to break field sterility if the surgeon had worn this two-toned gown. The risky areas are much more visible and less likely to be touched inadvertently.

Figure 4A:
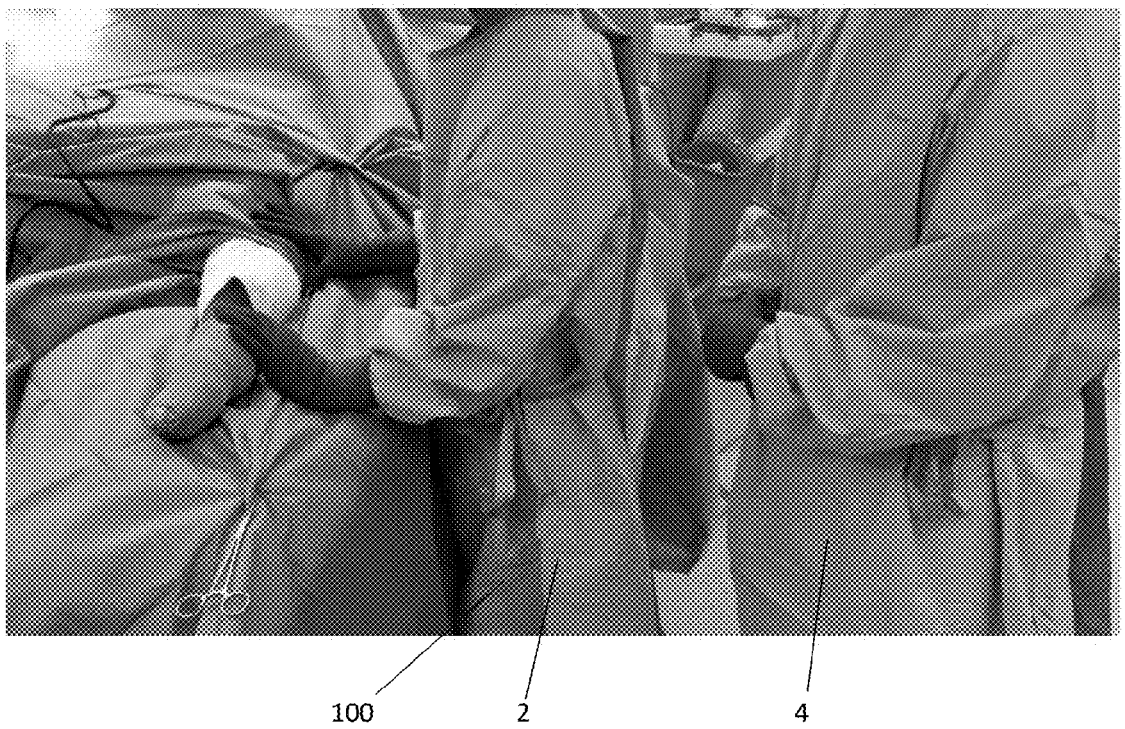
FIG. 4A is a photograph showing the surgical assistant too close to the surgeon's non sterile back of gown and without the color demarcation the assistant is less likely to maintain a greater distance and space.

FIG. 4A is a photograph showing the surgical assistant 4 too close to the surgeon's non sterile back 30 of prior art gown 100, and without the color demarcation the assistant is less likely to maintain a greater distance and space.

Figure 4B:
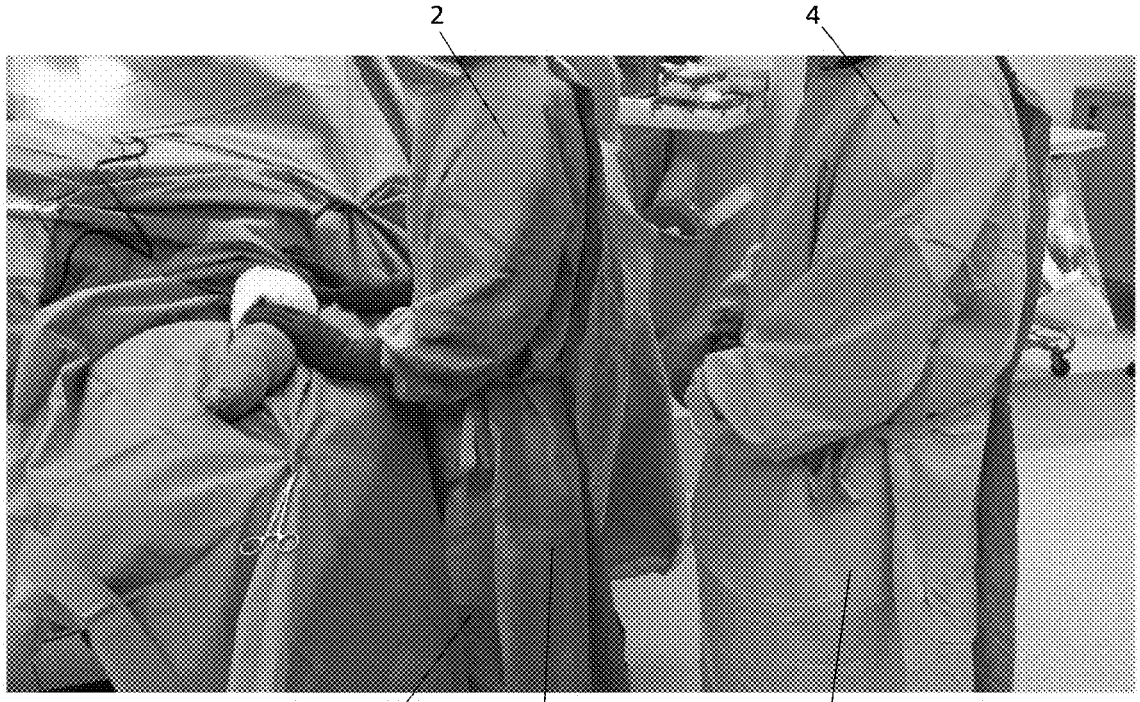
FIG. 4B similar to FIG. 4A, but now the surgical assistant has a better visual awareness of where behind the surgeon to maintain a safe distance to avoid compromising sterility of himself or herself.
Figure 5A:
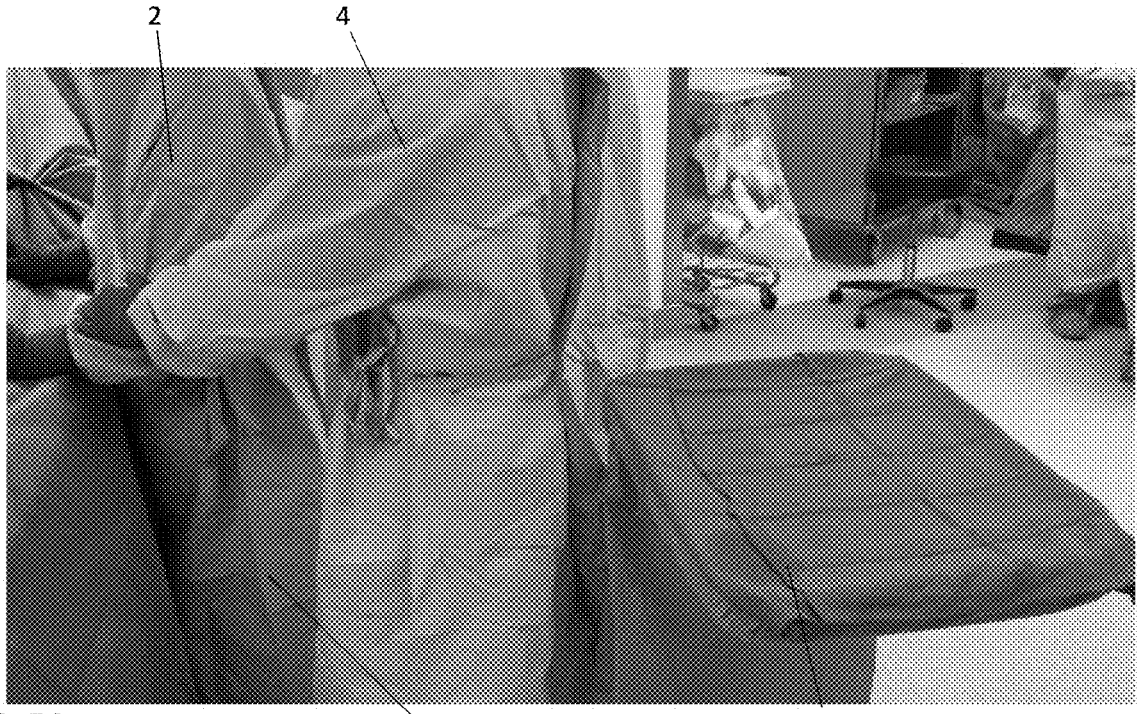
FIG. 5A is a photograph of an elevated 1 foot×2 foot (mayo) stand that is too close to the surgeon's back, it is difficult to position this stand most appropriately because of lack of a good visual landmark. This stand temporarily holds surgical instruments. Instruments that easily become contaminated if a member of the surgical team stands with their back too close to the stand, or more commonly someone inadvertently backs up too close and touches the stand with their dirty gown back or dirty gown sleeve backs.

FIG. 4B is similar to FIG. 4A, but now the surgical assistant 4 has a better visual awareness of where behind the surgeon to maintain a safe distance to avoid compromising sterility of him or herself . . . . FIG. 5A is a photograph of a mayo stand 60 that is too close to the surgeon's back 30, it is difficult to position appropriately because of lack of a good visual landmark using a prior art single color gown 100. This stand temporarily holds surgical instruments. Instruments that easily become contaminated if a member of the surgical team stands with their back too close to the stand, or more commonly someone inadvertently backs up too close and touches the stand with their dirty gown back or dirty gown sleeve backs.

Figure 5B:
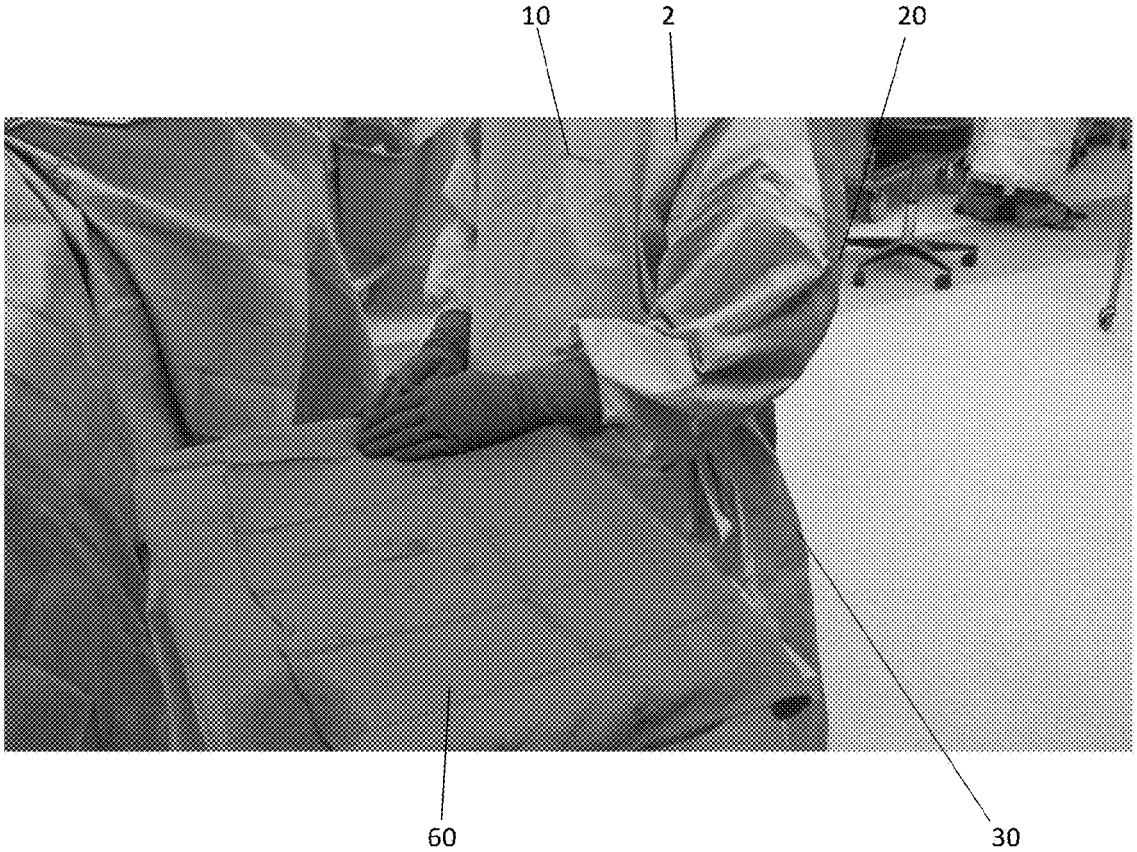
FIG. 5B similar to FIG. 5A, but now the mayo stand is not too close to the surgeon's back since it is easier to position appropriately because of the orange color on the back of the gown. Someone correctly placed the stand in front of the surgical team member away from the gown and sleeve backs. Contamination is more easily averted because of improved visual boundaries.

FIG. 5B is similar to FIG. 5A, but now the mayo stand 60 is not too close to the surgeon's back 30 since it is easier to position appropriately because of the orange color on the back 30 of the gown 10. Someone correctly placed the stand in front of the surgical team member away from the gown and sleeve backs. Contamination is more easily averted because of improved visual boundaries.

The two-toned surgical gown 10 would be similar to a standard commercially available surgical gown 100 except with contrasting or bright colors to back 30 of the gown 10 and back of the sleeves 20. The gown 10 can be made of cloth or any other material approved for operating room attire and which can be appropriately sterilized for said surgical usage. The two-toned gown areas intended to be painted or visually marked distinctive material would be in contrasting or bright colors including but not limited to orange, yellow and pink or any variation there of including patterned designs The two-toned gown areas intended to be visually marked or painted could have the paint modified or substituted for a colored resin 40 that would transfer from the gown 10 and stain whatever it came into contact with in either a permanent visually observable transfer or temporary fashion.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

The invention claimed is:

1. A sterility indicating operating room surgical gown comprises:

a two-toned surgical gown having outer surfaces of a first color indicating a sterile area, and outer surfaces of a contrasting second color added to back areas of the two-toned surgical gown including back areas of a pair of sleeves of the two-toned surgical gown to demark non-sterile areas of the two-toned surgical gown, the first color being of a blue or green color indicating the sterile area, the contrasting second color being yellow, orange, red or pink indicating the non-sterile area of a cautionary color indicating do not touch region of the two-toned surgical gown.

2. A sterility indicating operating room surgical gown comprises:

a two-toned surgical gown having outer surfaces of a first color indicating a sterile area and outer surfaces of a contrasting second color added to back areas of the two-toned surgical gown including back areas of a pair of sleeves of the two-toned surgical gown to demark non-sterile areas of the two-toned surgical gown, the first color being of a blue or green color indicating the sterile area, the contrasting second color being yellow, orange, red or pink indicating the non-sterile area of a cautionary color indicating do not touch region of the two-toned surgical gown wherein the non-sterile areas of the two-toned surgical gown of the contrasting second color are marked, painted or coated with a colored resin, the colored resin configured to transfer from the gown and stain whatever the non-sterile areas of the two-toned surgical gown came into contact with in either a permanent or temporary fashion.

3. The sterility indicating operating room surgical gown of claim 1 wherein the two-toned surgical gown is made of cloth.

4. The sterility indicating operating room surgical gown of claim 1 wherein the first color of the two-toned surgical gown is blue.

5. The sterility indicating operating room surgical gown of claim 2 wherein the two-toned surgical gown is made of cloth.

6. The sterility indicating operating room surgical gown of claim 2 wherein the first color of the two-toned surgical gown is blue.

* * * * *